US008291839B2

(12) United States Patent
Apps et al.

(10) Patent No.: US 8,291,839 B2
(45) Date of Patent: Oct. 23, 2012

(54) PALLET WITH ALIGNMENT FEATURES

(75) Inventors: William P. Apps, Alpharetta, GA (US); Sean T. Ogburn, Hoschton, GA (US); William Mead, Portland, OR (US); Ryan C. Meers, Los Angeles, CA (US)

(73) Assignee: Rehrig Pacific Company, Los Angeles, CA (US)

( * ) Notice: Subject to any disclaimer, the term of this patent is extended or adjusted under 35 U.S.C. 154(b) by 0 days.

(21) Appl. No.: 12/197,222

(22) Filed: Aug. 22, 2008

(65) Prior Publication Data

US 2010/0043676 A1 Feb. 25, 2010

(51) Int. Cl.
*B65D 19/38* (2006.01)

(52) U.S. Cl. ..... 108/57.25; 108/53.3

(58) Field of Classification Search ..... 108/53.1, 108/53.3, 53.5, 57.25, 51.3, 57.12, 91, 92; 206/386; 248/346.02
See application file for complete search history.

(56) References Cited

U.S. PATENT DOCUMENTS

| | | | | | |
|---|---|---|---|---|---|
| 3,276,808 | A | | 10/1966 | Scaramuzzi | |
| 3,380,403 | A | | 4/1968 | Sullivan | |
| 3,424,110 | A | * | 1/1969 | Toot | 108/53.3 |
| 3,526,195 | A | * | 9/1970 | Maryonovich | 108/53.1 |
| 3,611,952 | A | * | 10/1971 | Hoffman | 108/11 |
| 3,626,860 | A | * | 12/1971 | Blatt | 108/51.3 |
| 3,702,100 | A | | 11/1972 | Wharton | |
| 3,719,157 | A | * | 3/1973 | Arcocha et al. | 108/57.25 |
| 4,159,681 | A | | 7/1979 | Vandament | |
| 4,221,751 | A | * | 9/1980 | Haataja et al. | 108/53.3 |
| 4,226,192 | A | * | 10/1980 | Myers | 108/53.1 |
| 4,610,355 | A | * | 9/1986 | Maurer | 206/599 |
| 4,674,414 | A | * | 6/1987 | Nulle et al. | 108/53.3 |
| 4,717,025 | A | * | 1/1988 | Maurer | 206/599 |
| 4,850,284 | A | | 7/1989 | DeGroot et al. | |
| 4,879,956 | A | | 11/1989 | Shuert | |
| 5,050,506 | A | | 9/1991 | Fiedler | |
| 5,057,350 | A | | 10/1991 | Gezels | |
| 5,289,781 | A | | 3/1994 | Beckway | |
| 5,341,748 | A | * | 8/1994 | Liu | 108/53.3 |
| 5,401,456 | A | | 3/1995 | Alesi, Jr. et al. | |
| 5,425,521 | A | * | 6/1995 | Locke | 248/346.02 |
| 5,520,120 | A | | 5/1996 | Badger | |

(Continued)

FOREIGN PATENT DOCUMENTS

EP 0 479 073 4/1992

(Continued)

OTHER PUBLICATIONS

European Search Report for EP Application No. 09168244.3, Nov. 24, 2009.

(Continued)

*Primary Examiner* — Jose V Chen
(74) *Attorney, Agent, or Firm* — Carlson, Gaskey & Olds, P.C.

(57) ABSTRACT

A pallet according to one embodiment includes a deck and a plurality of columns extending downward from the deck. In order to increase the stability of the pallet on a fork, at least one alignment feature protrudes downward from the deck between the pair of columns. The alignment feature extends downwardly substantially less than the columns, such that the alignment feature does not contact the floor and does not significantly increase the weight of the pallet. In another feature, preformed foam inserts are inserted into the cavities of the columns and/or the alignment features.

20 Claims, 10 Drawing Sheets

U.S. PATENT DOCUMENTS

| | | | | |
|---|---|---|---|---|
| 5,551,353 | A | 9/1996 | Fiedler | |
| 5,664,934 | A * | 9/1997 | Schaede et al. | 108/53.1 |
| 5,702,034 | A | 12/1997 | Semenenko | |
| 5,813,355 | A * | 9/1998 | Brown et al. | 108/53.3 |
| 5,868,080 | A | 2/1999 | Wyler et al. | |
| 5,950,545 | A | 9/1999 | Shuert | |
| 5,996,508 | A * | 12/1999 | Constantino et al. | 108/57.25 |
| 6,029,583 | A | 2/2000 | LeTrudet | |
| 6,032,801 | A | 3/2000 | Jupille et al. | |
| 6,220,183 | B1 * | 4/2001 | Schwitzky | 108/53.3 |
| 6,257,152 | B1 * | 7/2001 | Liu | 108/53.3 |
| 6,418,861 | B1 | 7/2002 | Flam | |
| 6,705,237 | B2 | 3/2004 | Moore, Jr. et al. | |
| 6,718,888 | B2 | 4/2004 | Muirhead | |
| 6,935,249 | B2 | 8/2005 | Moore, Jr. et al. | |
| 6,955,129 | B2 | 10/2005 | Moore, Jr. et al. | |
| 7,128,797 | B2 * | 10/2006 | Dummett | 156/212 |
| 7,308,857 | B2 | 12/2007 | Moore, Jr. et al. | |
| 7,413,698 | B2 * | 8/2008 | Bearse et al. | 264/511 |
| 2004/0112261 | A1 | 6/2004 | Moore, Jr. et al. | |
| 2004/0221771 | A1 | 11/2004 | Moore, Jr. et al. | |
| 2004/0255828 | A1 | 12/2004 | Markling et al. | |
| 2005/0211139 | A1 * | 9/2005 | Perrotta et al. | 108/57.25 |
| 2005/0263044 | A1 | 12/2005 | Bearse et al. | |
| 2006/0201402 | A1 | 9/2006 | Moore, Jr. et al. | |
| 2006/0236903 | A1 | 10/2006 | Moore, Jr. | |
| 2006/0249058 | A1 | 11/2006 | Moore, Jr. et al. | |
| 2006/0254477 | A1 | 11/2006 | Moore, Jr. et al. | |
| 2006/0254478 | A1 | 11/2006 | Kruger et al. | |
| 2006/0260517 | A1 | 11/2006 | Moore, Jr. | |
| 2007/0012225 | A1 | 1/2007 | Moore, Jr. | |
| 2007/0028814 | A1 | 2/2007 | Swistak et al. | |
| 2007/0051283 | A1 | 3/2007 | Moore, Jr. | |
| 2007/0234933 | A1 | 10/2007 | Donnell, Jr. et al. | |
| 2009/0050030 | A1 * | 2/2009 | Apps et al. | 108/53.3 |

FOREIGN PATENT DOCUMENTS

| | | |
|---|---|---|
| EP | 1 566 348 | 8/2005 |
| FR | 2 229 622 A1 | 12/1974 |

OTHER PUBLICATIONS

European Search Report for EP Application No. 09168244.3, Mar. 17, 2010.

* cited by examiner

PALLET WITH ALIGNMENT FEATURES

BACKGROUND OF THE INVENTION

Pallets are used to support goods above the floor for shipping and storage. Many pallets are now plastic. A pallet includes at least one deck for supporting the goods. A plurality of columns extend downwardly from the deck to support the deck above the floor. Openings between the columns receive forks of a forklift or a pallet jack. Some pallets are nestable, that is, the columns of one pallet are received through openings in the deck and into the columns of another pallet. This reduces the stacking height of the pallets when the pallets are empty.

Some pallets have nine columns, including four corner columns, side or end columns between the corner columns on each side or end of the pallet, and a center column. Each tine of a fork is inserted on either side of the side or end columns. However, some pallets, such as half pallets, do not include side or end columns. Therefore, more care is required to ensure that the fork is substantially centered on the pallet deck prior to lifting the pallet off the floor.

The columns of the pallets are often subject to high impact from the forks. It has been proposed to spray structural foam into the hollow plastic columns in order to increase the impact resistance of the columns. However, this makes it very difficult to recycle the plastic pallet, as the structural foam cannot be recycled with the pallet.

SUMMARY OF THE INVENTION

A pallet according to one embodiment of the present invention includes a deck and a plurality of columns extending downward from the deck. In order to increase the stability of the pallet on a fork, at least one alignment feature protrudes downward from the deck between the pair of columns. The alignment feature extends downwardly substantially less than the columns, such that the alignment feature does not contact the floor and does not significantly increase the weight of the pallet.

If the pallet is a nestable pallet, each of the columns includes a corresponding opening through the deck into which the columns of similar pallet are received when stacking. Similarly, each alignment feature includes a corresponding opening through the deck for receiving the alignment feature of a similar deck nested thereon.

In another feature of the present invention, preformed foam inserts are inserted into the cavities of the columns and/or the alignment features. The foam inserts are formed of the same polymer as the rest of the pallet, but in a foam form. Therefore, the entire pallet can be recycled without removing the foam inserts. The foam inserts increase the impact resistance and strength of the columns and/or alignment features.

These and other features of the application can be best understood from the following specification and drawings, the following of which is a brief description.

DETAILED DESCRIPTION OF THE PREFERRED EMBODIMENTS

Figure 1:
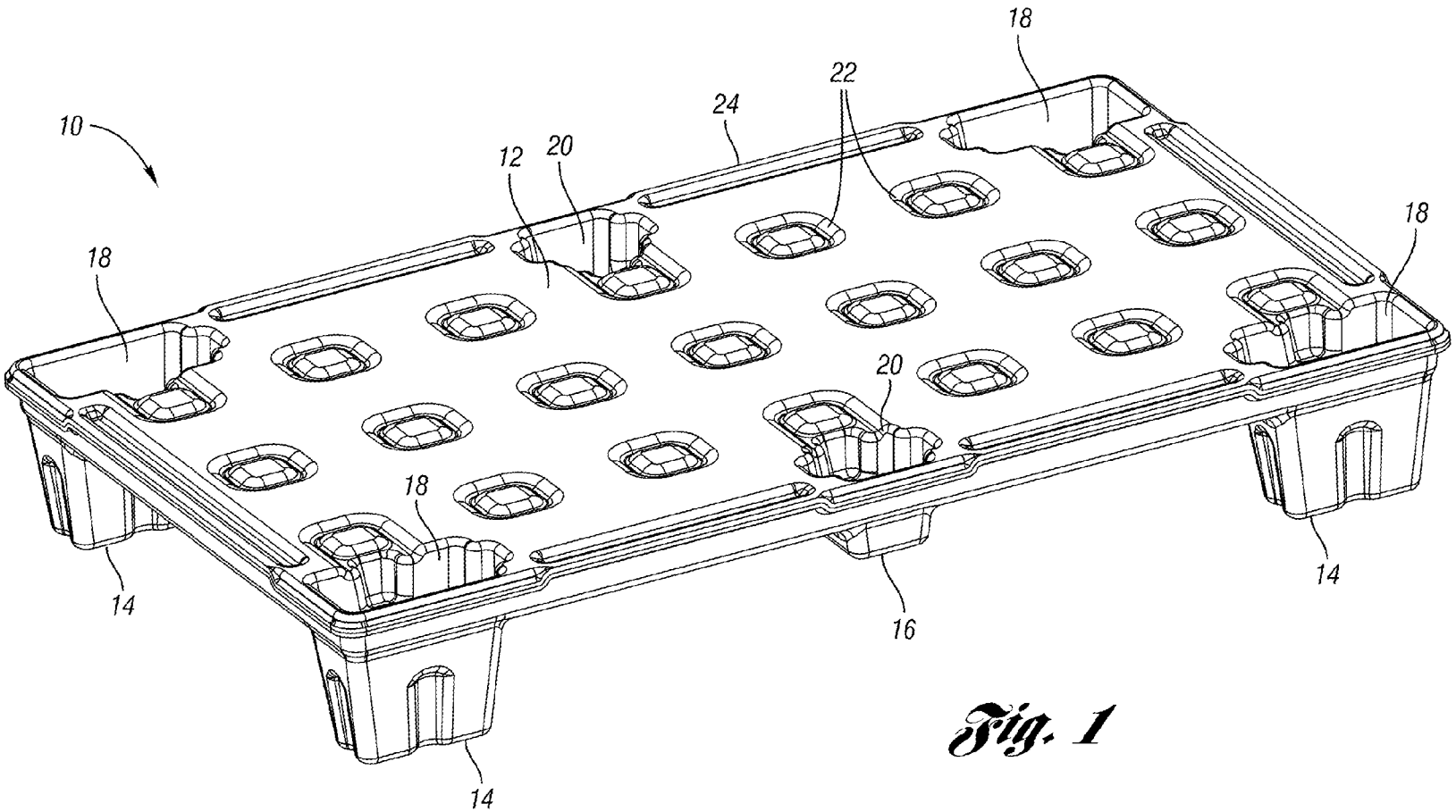
FIG. 1 is a top perspective view of a pallet according to a first embodiment of the present invention.

FIG. 1 illustrates a pallet 10 according to a first embodiment of the present invention. The pallet 10 includes a deck 12 having a plurality of columns 14 extending downwardly therefrom. In this particular embodiment, the columns 14 extend downward from each of the corners of the deck 12. A pair of alignment features 16 extend downward from the deck 12 adjacent the center of each long side of the pallet 10. Each of the columns 14 includes a corresponding cavity or opening through the deck 12. Similarly, each of the alignment features 16 includes a corresponding opening or cavity 20 extending through the deck 12. A plurality of reinforced areas 22 are formed in the upper surface of the deck 12 and reinforcement channels 24 are formed along the edges of the deck 12.

Figure 2:
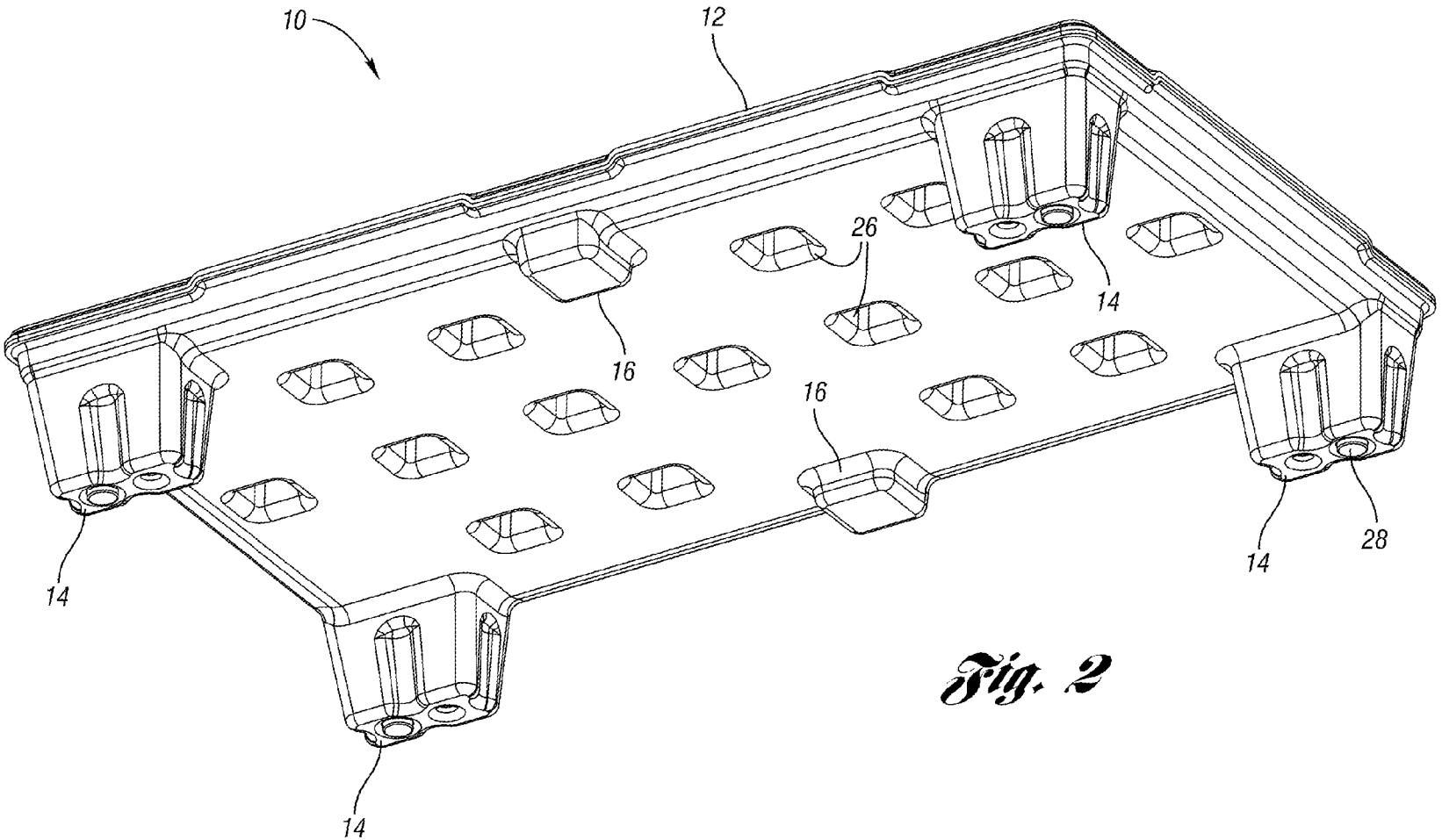
FIG. 2 is a bottom perspective view of the pallet of FIG. 1.

Referring to FIG. 2, rubber grommets 28 are pressed into the bottoms of the columns 14 as anti-skid features. The bottom surface of the deck 12 includes recesses 26 that reinforce the deck 12 and are aligned with the reinforced areas 22 (FIG. 1) on the upper surface of the deck 12.

Figure 3:
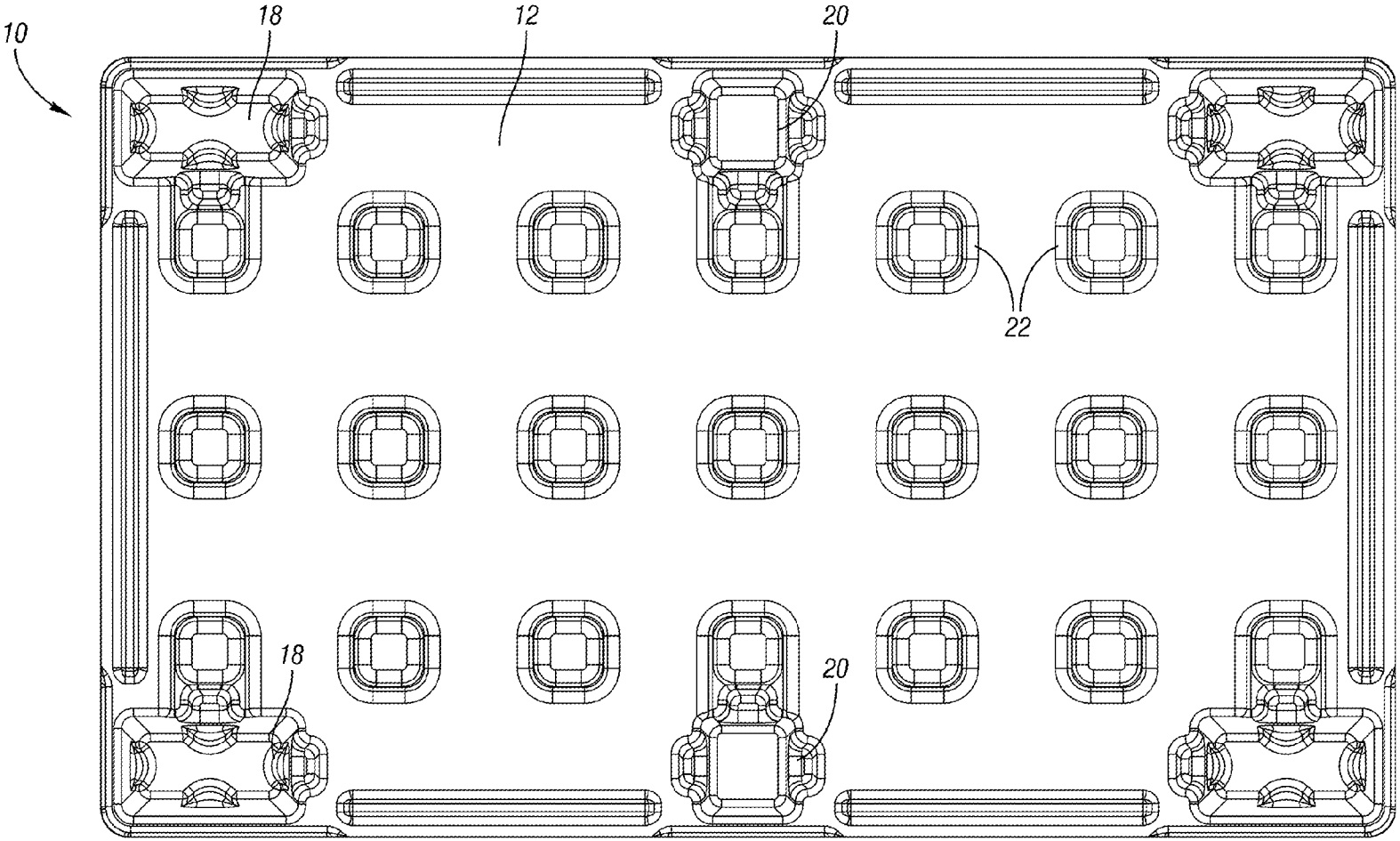
FIG. 3 is a top view of the pallet of FIG. 1.
Figure 4:
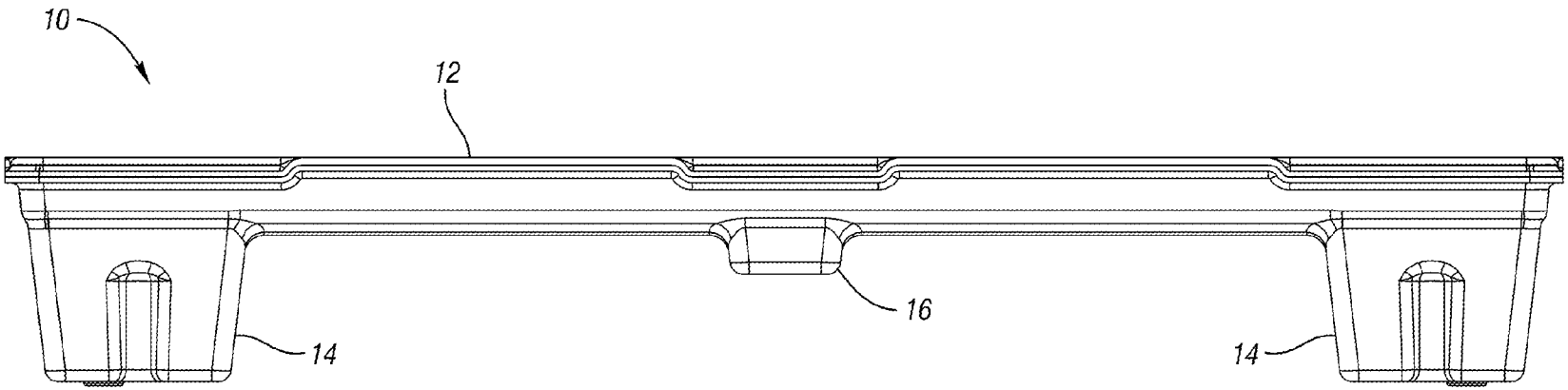
FIG. 4 is a side view of the pallet of FIG. 1.
Figure 5:
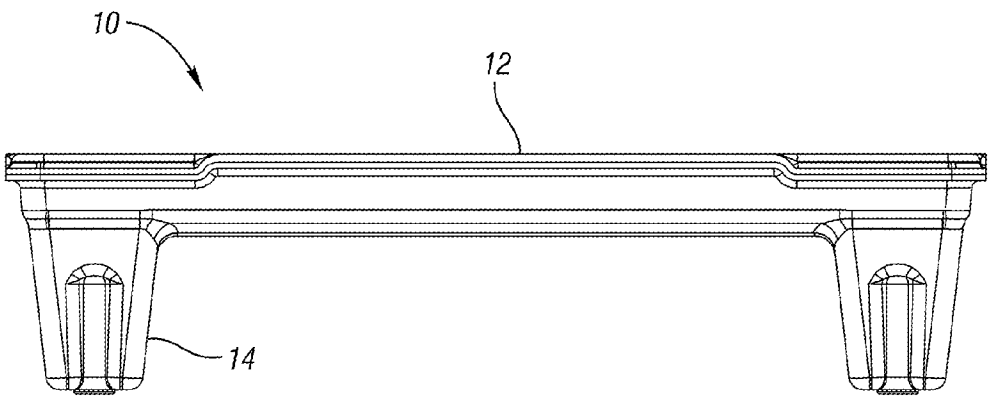
FIG. 5 is an end view of the pallet of FIG. 1.

FIG. 3 is a top view of the pallet 10. FIG. 4 is a side view of the pallet 10. As shown, the alignment feature 16 extends down from the deck 12 approximately one-third the length of the columns 14 and is approximately half as wide as the columns 14. FIG. 5 is an end view of the pallet 10.

Figure 6:
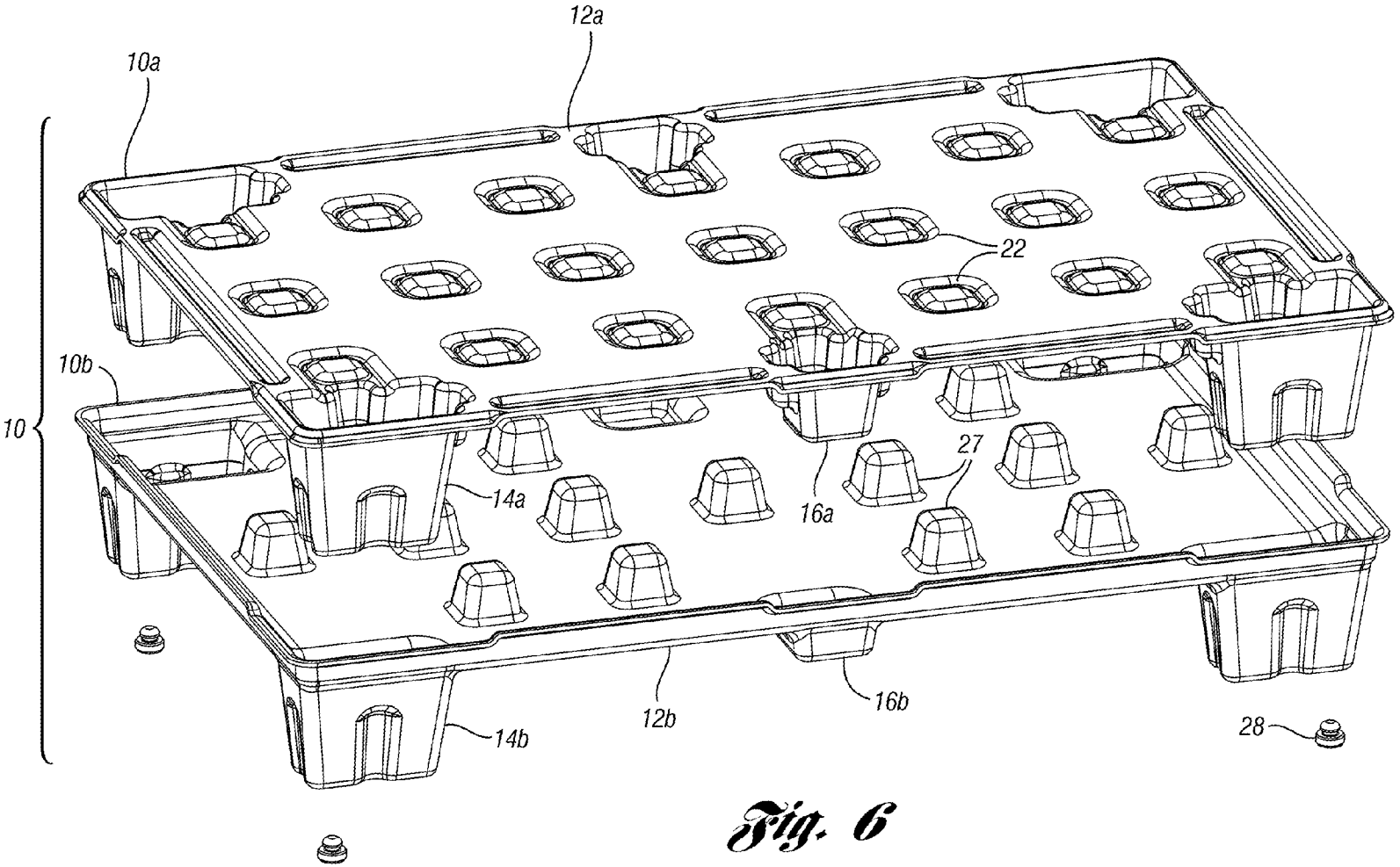
FIG. 6 is an exploded perspective view of the pallet of FIG. 1.

FIG. 6 is an exploded perspective view of the pallet 10 of FIG. 1. As shown, the pallet 10 is formed from two halves: upper half 10*a* and lower half 10*b*. The halves 10*a*, 10*b* may be formed from separate polymer sheets that are formed and joined in a twin-sheet thermoforming process. Alternatively, the halves could be injection molded separately and then joined via vibration welding, adhesive, snap fit, heat stakes, etc. The upper half 10*a* includes inner column portions 14*a* and inner alignment feature portions 16*a* that are aligned with and received within outer column portions 14*b* and outer alignment feature portions 16*b* on the lower half 10*b*. The recesses 26 (FIG. 2) on the lower half 10*b* of the pallet 10 create corresponding upwardly protruding portions 27 that connect to the reinforced areas 22 of the upper half 10*a*.

Figure 7:
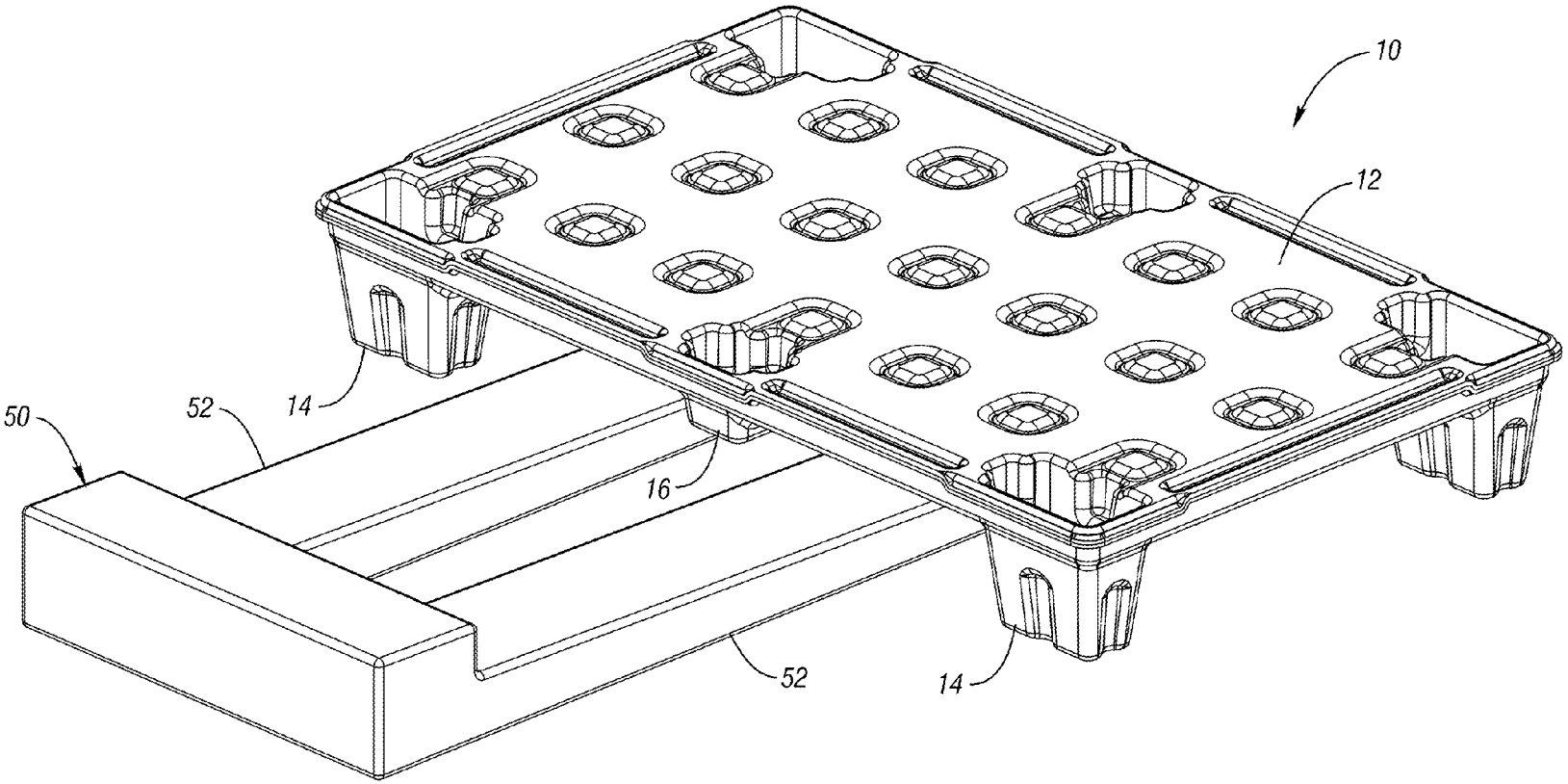
FIG. 7 is a perspective view of the pallet of FIG. 1 being engaged by a fork.

FIG. 7 is a perspective view of the pallet 10 being engaged by a fork 50. As shown, the alignment features 16 are received between the tines 52 of the fork 50. The alignment features 16 prevent the pallet 10 from sliding sideways on the fork 50 because, as shown, the alignment features 16 would contact one of the tines 52 to prevent further movement.

Figure 8:
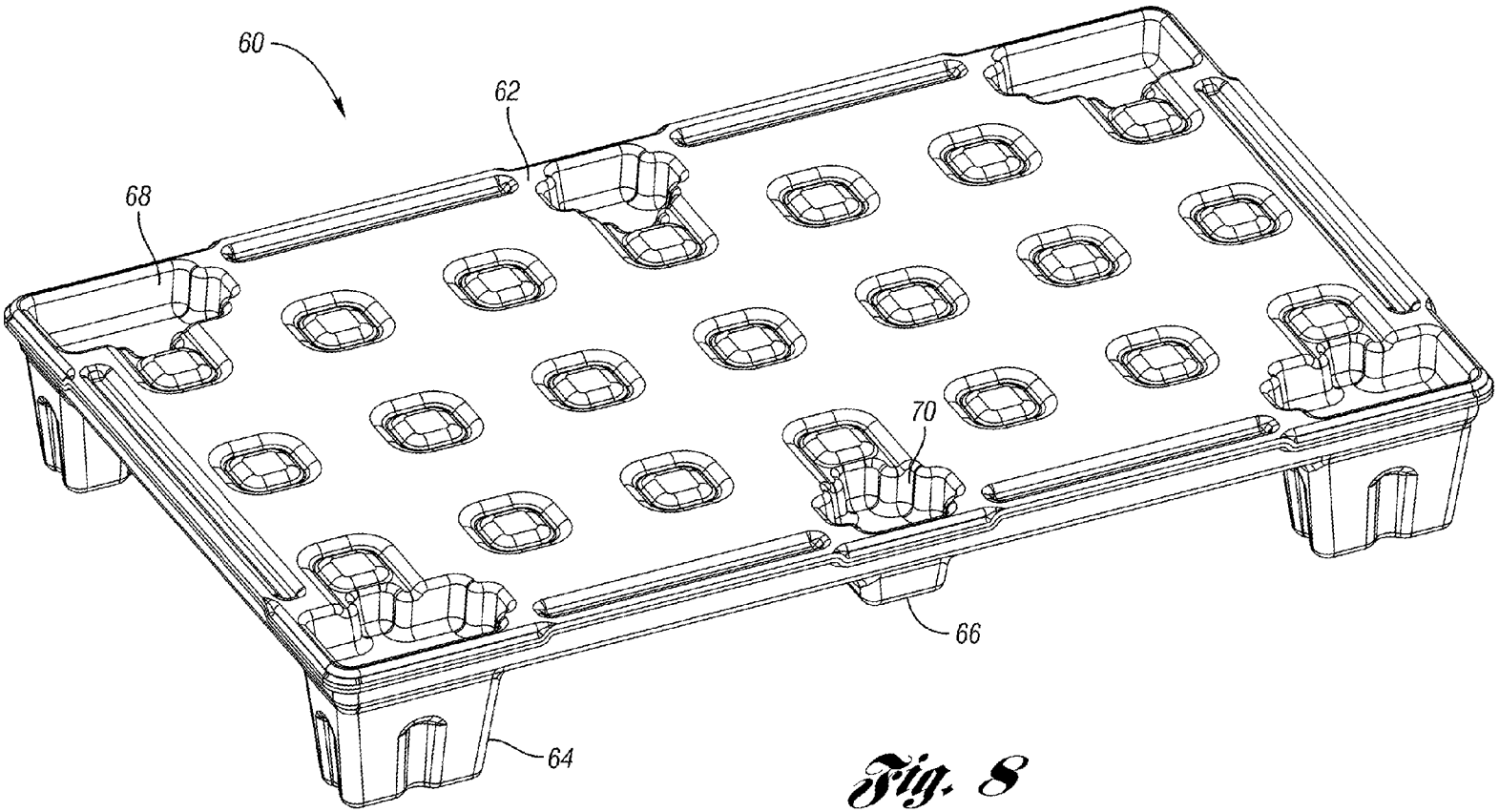
FIG. 8 is a top perspective view of the pallet according to a second embodiment of the present invention.

FIG. 8 is a top perspective view of the pallet 10 according to a second embodiment of the present invention. The pallet 10 includes a deck 62, columns 64 and alignment features 66, with corresponding openings 68, 70, respectively, generally as shown and explained with respect to the first embodiment except as described below or as shown in the drawings.

Figure 9:
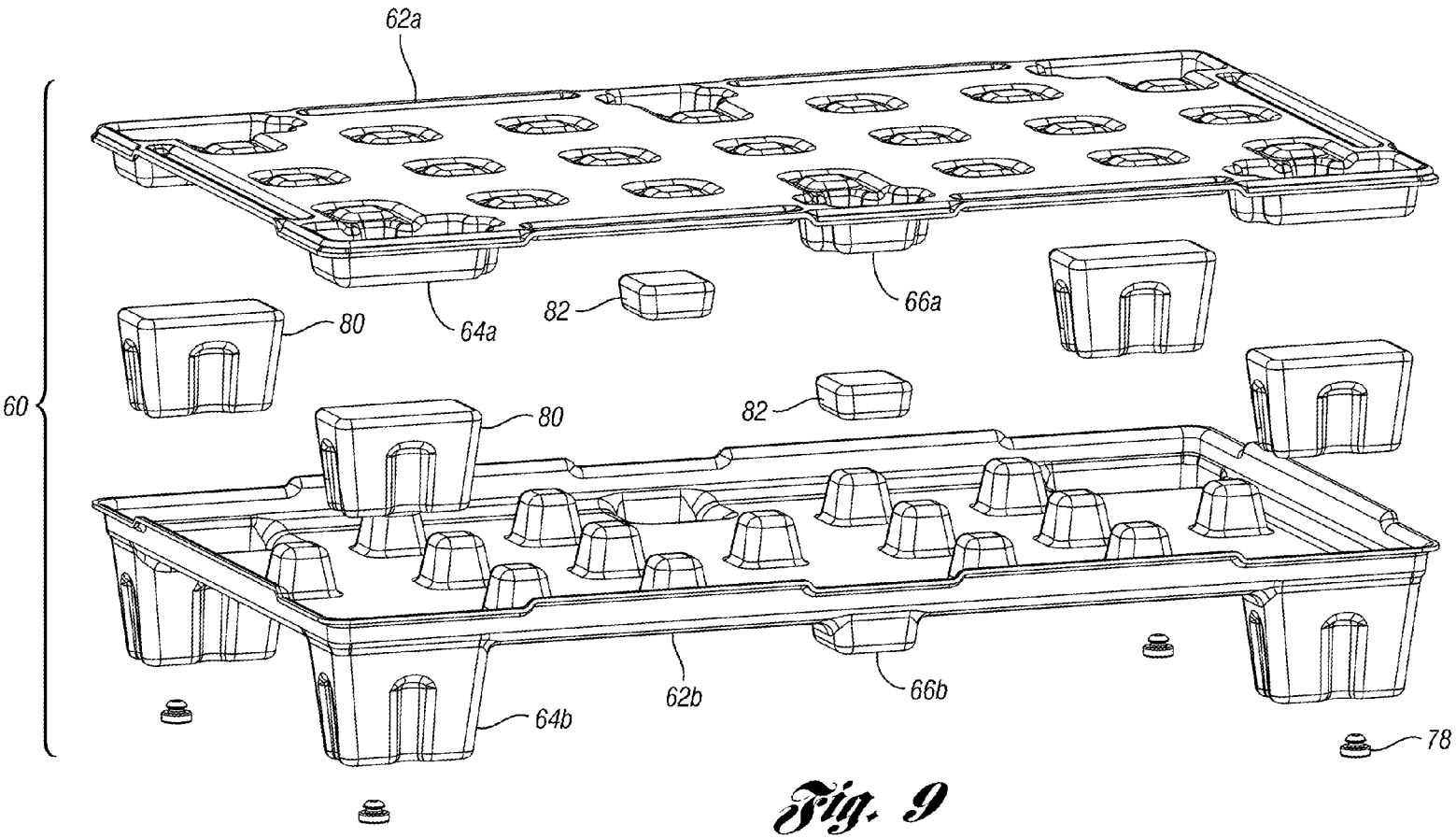
FIG. 9 is an exploded view of the pallet of FIG. 8.
Figure 10:
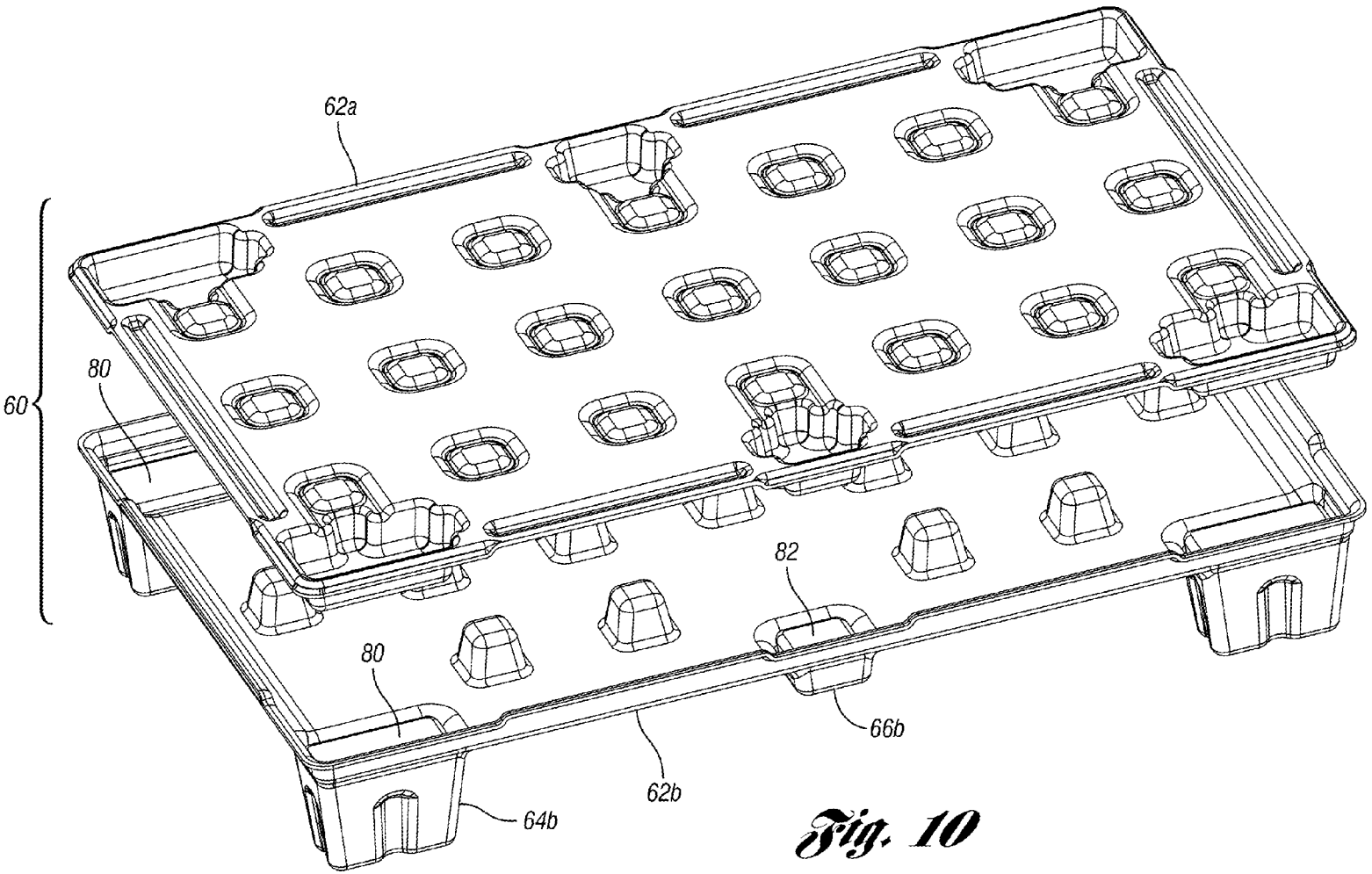
FIG. 10 is a partially assembled view of the pallet of FIG. 9.

FIG. 9 is an exploded view of the pallet 10 of FIG. 8. As shown, the upper half 62*a* of the pallet 60 includes shallow inner column portions 64*a* and inner alignment feature portions 66*a*. This is to accommodate pre-formed foam inserts 80 in the outer column portions 64*b* and pre-formed foam inserts 82 in the outer alignment feature portions 66*b* of the lower half 62*b*. The pre-formed foam inserts 80, 82 could be located in just the columns 14, or just one or some of the columns 14, or just one or some of the alignment features 16, or combinations thereof. The foam inserts 80, 82 are the same polymer as the rest of the pallet 60, but in foam form, such that the entire pallet 60 can be recycled together. For example the foam inserts 80, 82 can be expanded polypropylene (EPP), while the rest of the pallet 60 is polypropylene. Again, rubber grommets 78 are optionally provided in the bottom surface of the columns 64.

In assembly, the lower half 62*b* is formed as shown and the foam inserts 80, 82 are placed in the outer column portions 64*b* and outer alignment feature portions 66*b*, as shown FIG. 9. This may happen as part of the thermoforming process or after injection molding the halves 62*a*, 62*b*, prior to connection of the halves 62*a*, 62*b*.

Figure 11:
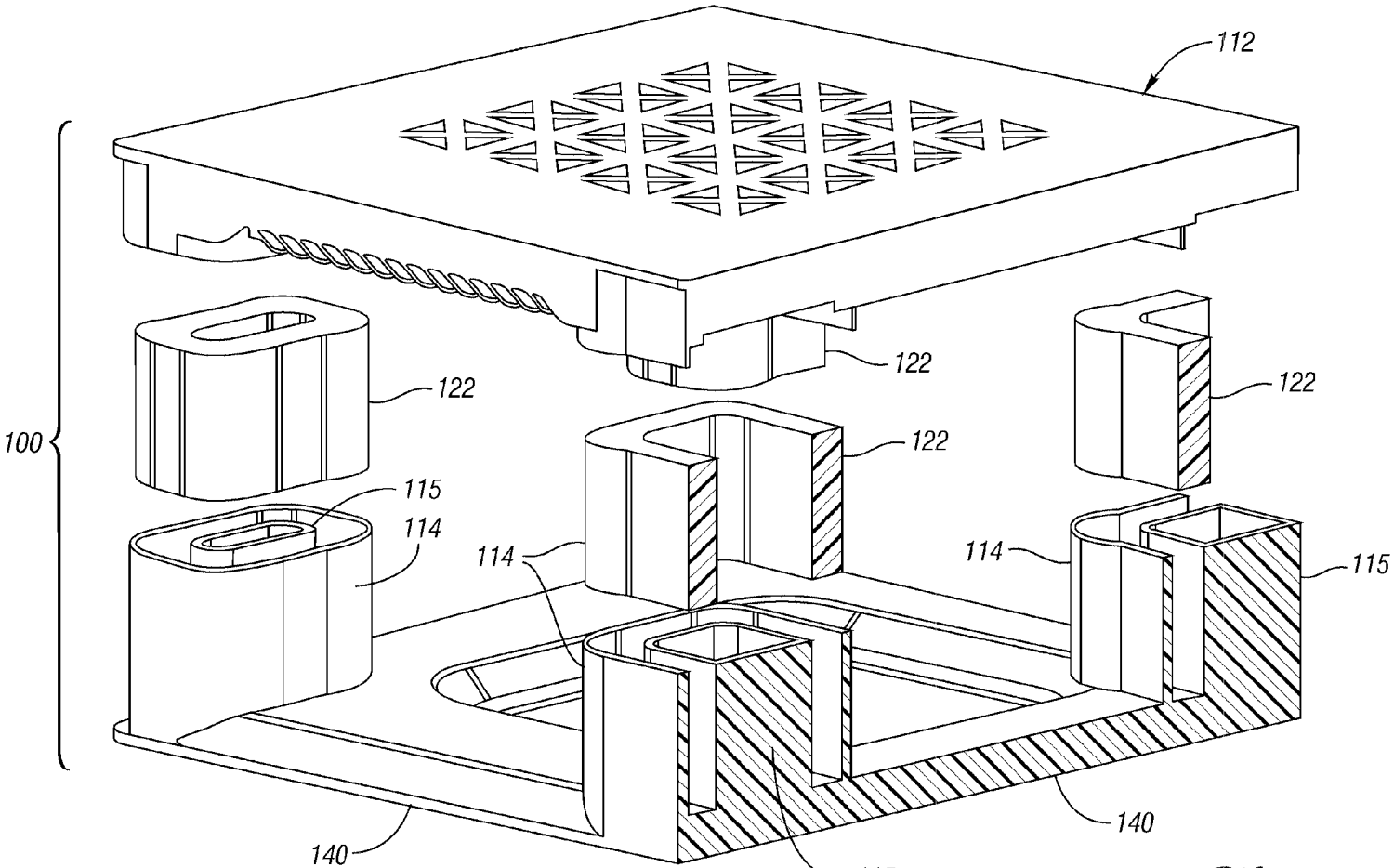
FIG. 11 is a exploded partial view of a pallet according to a third embodiment.

FIG. 11 is an exploded quarter view of a pallet 100 according to a third embodiment. The pallet 100 includes an upper deck 112, columns 114 and runners 140 (or a lower deck 140). The columns 114 are integrally formed with the runners 140 and include inner column portions 115, also integrally molded with the columns 114 and runners 140. Pre-formed foam inserts 122 are inserted into the columns 114 between the outer walls and the inner column portions 115 to increase the strength and impact resistance of the columns 114. In this embodiment, the foam inserts 122 are annular and have an opening for receiving the inner column portion 115. The upper deck 112 is then vibration welded (or connected via snap-fit, adhesive or hot plate welding or other suitable methods) to the columns 114, over the foam inserts 122. The foam inserts 122 are preferably the same polymer, but in foam form, as the rest of the pallet 100. For example, the foam inserts 122 can be expanded polypropylene (EPP), while the rest of the pallet 100 is polypropylene. As a result, the entire pallet 100 (including the inserts 122) can be recycled together.

In accordance with the provisions of the patent statutes and jurisprudence, exemplary configurations described above are considered to represent a preferred embodiment of the invention. However, it should be noted that the invention can be practiced otherwise than as specifically illustrated and described without departing from its spirit or scope.

What is claimed is:

1. A pallet comprising:

a deck including an upper sheet and a lower sheet;

a first pair of columns extending downward from the deck along a first side of the deck, the deck not including any other columns extending downward from the deck between the first pair of columns;

a second pair of columns extending downward from the deck along a second side of the deck, the deck not including any other columns extending downward from the deck between the second pair of columns;

at least one first alignment feature protruding downward from the deck between the first pair of columns, the at least one first alignment feature protruding downward from the deck less than the first pair of columns; at least one second alignment feature protruding downward from the deck between the second pair of columns, the at least one second alignment feature protruding downward from the deck less than the second pair of columns; and a foam insert positioned within at least one of the first pair of columns and between the upper and lower sheets;

wherein the first and second pair of columns are hollow and align with openings through the deck such that columns of a similar pallet are nestable with the first and second pair of columns.

2. The pallet of claim 1 wherein the at least one first alignment feature is hollow and aligned with an opening through the deck such that the at least one first alignment feature of the similar pallet can nest within the at least one first alignment feature.

3. The pallet of claim 2 wherein the deck includes an upper sheet and a lower sheet.

4. The pallet of claim 2 wherein the at least one first alignment feature is centered between the first pair of columns.

5. The pallet of claim 1 wherein the foam insert is formed of a polymer that is the same as a polymer of the first pair of columns.

6. A pallet comprising:

a deck including an upper sheet and a lower sheet;

a first pair of columns extending downward from the deck along a first side of the deck, the deck not including any other columns extending downward from the deck between the first pair of columns;

a second pair of columns extending downward from the deck along a second side of the deck, the deck not including any other columns extending downward from the deck between the second pair of columns;

at least one first alignment feature protruding downward from the deck between the first pair of columns, the at least one first alignment feature protruding downward from the deck less than the first pair of columns;

at least one second alignment feature protruding downward from the deck between the second pair of columns, the at least one second alignment feature protruding downward from the deck less than the second pair of columns;

wherein the first and second pair of columns are hollow and align with openings through the deck such that columns of a similar pallet are nestable with the first and second pair of columns; and a first foam insert positioned within the at least one first alignment feature and between the upper and lower sheets.

7. The pallet of claim 6 further including a pair of second foam inserts positioned within the first pair of columns and between the upper and lower sheets.

8. A pallet comprising:

a deck;

a plurality of columns extending downward from the deck;

a plurality of separate foam inserts, each one of the plurality of separate foam inserts received in a respective one of the plurality of columns, wherein the plurality of foam inserts are formed of a polymer that is the same as a polymer of the plurality of columns; and wherein the plurality of foam inserts are preformed such that the plurality of foam inserts are formed prior to being received in the respective ones of the plurality of columns.

9. The pallet of claim 8 wherein the deck is formed of an upper sheet and a lower sheet, the plurality of foam inserts between the upper sheet and the lower sheet.

10. The pallet of claim 8 wherein the plurality of columns are formed of polypropylene and the plurality of foam inserts are formed of expanded polypropylene.

11. The pallet of claim 8 wherein the plurality of columns are molded integrally with the deck.

12. The pallet of claim 8 wherein the plurality of columns are molded separately from the deck.

13. The pallet of claim 8 wherein the deck includes an upper sheet and a lower sheet, the plurality of columns defined by both the upper and lower sheets.

14. A method for assembling a pallet including the steps of:

a) forming a deck;

b) forming a plurality of projections extending downward from the deck;

c) pre-forming a plurality of foam inserts, wherein the foam inserts are formed of a polymer that is the same as a polymer of the plurality of projections; and d) placing each of the plurality of pre-formed foam inserts into a different one of the plurality of projections after said step c).

15. The method of claim 14 wherein the step of forming the deck includes the steps of forming an upper sheet and a lower sheet, the foam inserts placed between the upper sheet and the lower sheet.

16. The method of claim 14 wherein the plurality of projections are formed of polypropylene and the foam insert is formed of expanded polypropylene.

17. The pallet of claim 1 wherein the first alignment feature is the lowest portion of the pallet between the first pair of columns.

18. The pallet of claim 1 wherein there is only one first alignment feature between the first pair of columns.

19. The pallet of claim 18 wherein there is only one second alignment feature between the second pair of columns.

20. The pallet of claim 1 wherein the deck includes an upper sheet and a lower sheet, the first and second pair of columns defined by both the upper and lower sheets.

* * * * *